US011473299B1

(12) United States Patent
Callahan et al.

(10) Patent No.: US 11,473,299 B1
(45) Date of Patent: Oct. 18, 2022

(54) SYSTEMS, DEVICES, AND/OR METHODS FOR BUILDING CONSTRUCTION

(71) Applicants: Robert M. Callahan, Boones Mill, VA (US); Shawn A. Callahan, Blue Ridge, VA (US)

(72) Inventors: Robert M. Callahan, Boones Mill, VA (US); Shawn A. Callahan, Blue Ridge, VA (US)

( * ) Notice: Subject to any disclaimer, the term of this patent is extended or adjusted under 35 U.S.C. 154(b) by 0 days.

(21) Appl. No.: 17/245,143

(22) Filed: Apr. 30, 2021

(51) Int. Cl.

| | |
|---|---|
| ***E04B 2/80*** | (2006.01) |
| ***E04B 1/76*** | (2006.01) |
| ***E04B 1/64*** | (2006.01) |
| ***E04B 2/76*** | (2006.01) |

(52) U.S. Cl.
CPC ..... *E04B 2/80* (2013.01); *E04B 1/642* (2013.01); *E04B 1/7604* (2013.01); *E04B 2/768* (2013.01)

(58) Field of Classification Search
CPC ..... E04B 2/80; E04B 1/642; E04B 1/7604; E04B 2/768; E04B 2/42; E04B 2/562; E04B 2/705; E04F 13/0803
See application file for complete search history.

(56) References Cited

U.S. PATENT DOCUMENTS

| | | | | |
|---|---|---|---|---|
| 3,230,684 A * | 1/1966 | Vinje | E04F 13/0803 403/345 |
| 4,930,278 A * | 6/1990 | Staresina | E04F 13/0862 52/600 |
| 6,125,608 A * | 10/2000 | Charlson | F16B 33/02 52/847 |
| 10,995,497 B1 * | 5/2021 | Horne | E04D 1/34 |
| 2014/0373477 A1 * | 12/2014 | Nemmer | E04C 3/09 52/741.1 |

* cited by examiner

*Primary Examiner* — Patrick J Maestri
(74) *Attorney, Agent, or Firm* — Dale Jensen, PLC; Dale Jensen

(57) ABSTRACT

Certain exemplary embodiments can provide a wall frame comprising a top plate, a bottom plate, a first end column, a second end column, a plurality of studs, and a plurality of purlins. Each of the plurality of purlins is an edge of a pair of cells, the pair of cells having edges comprising three edges that comprise one or more of a part of the top plate, a part of the bottom plate, a part of the first end column, a part of the second end column, a part of the plurality of studs, and another of the plurality of purlins.

11 Claims, 7 Drawing Sheets

1000

2000

3000

6000

7000

SYSTEMS, DEVICES, AND/OR METHODS FOR BUILDING CONSTRUCTION

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments can provide a wall frame comprising a top plate, a bottom plate, a first end column, a second end column, a plurality of studs, and a plurality of purlins. Each of the plurality of purlins is an edge of a pair of cells, the pair of cells having edges comprising three edges that comprise one or more of a part of the top plate, a part of the bottom plate, a part of the first end column, a part of the second end column, a part of the plurality of studs, and another of the plurality of purlins.

Figure 1:
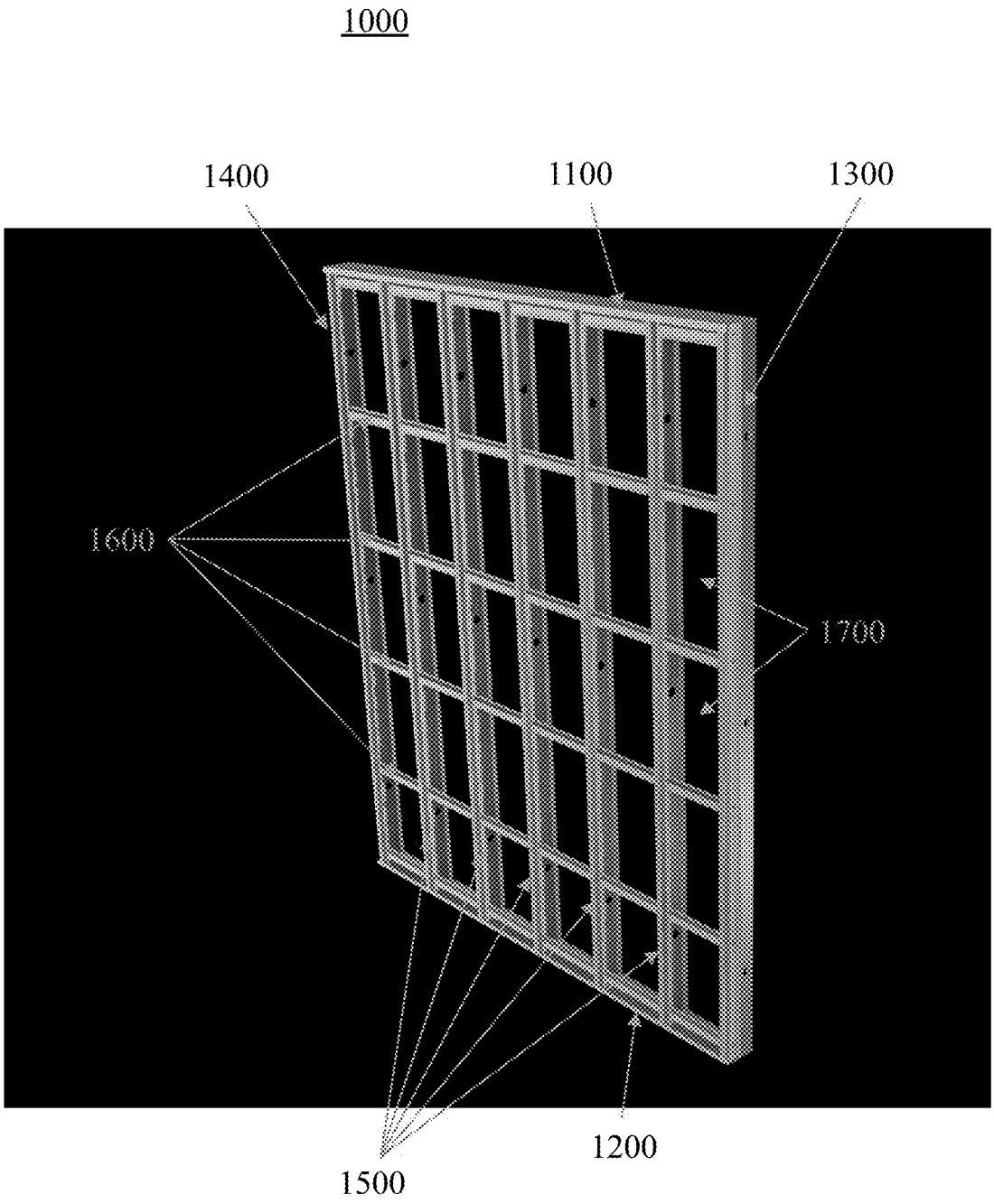
FIG. 1 is a perspective view of an exemplary embodiment of a wall frame 1000.

FIG. 1 is a perspective view of an exemplary embodiment of a wall frame 1000

Wall frame 1000 comprises:

a top plate 1100;

a bottom plate 1200;

a first end column 1300;

a second end column 1400;

a plurality of studs 1500; and a plurality of purlins 1600, wherein each of the plurality of purlins is an edge of a pair of cells 1700, pair of cells 1700 having edges comprising three edges that comprise one or more of a part of top plate 1100, a part of bottom plate 1200, a part of first end column 1300, a part of second end column 1400, a part of plurality of studs 1500, and another of plurality of purlins 1600.

Wall frame 1000 can comprise:

metal;

wood; and/or wood and metal.

Plurality of purlins 1600 can comprise:

metal;

wood; and/or wood and metal.

Each of first end column 1300, second end column 1400, and plurality of studs 1500 define at least one set of aligned apertures, the at least one set of aligned apertures (see apertures 5200 of FIG. 5) constructed to receive a rod (see rod 5300 of FIG. 5), the rod constructed to couple wall frame 1000 to another building component.

Plurality of purlins 1600 can be recessed relative to a plane (see plane 5100 of FIG. 5) defined by a cap (see cap 4300 of FIG. 4) of each of top plate 1100, bottom plate 1200, first end column 1300, second end column 1400, and plurality of studs 1500.

Figure 2:
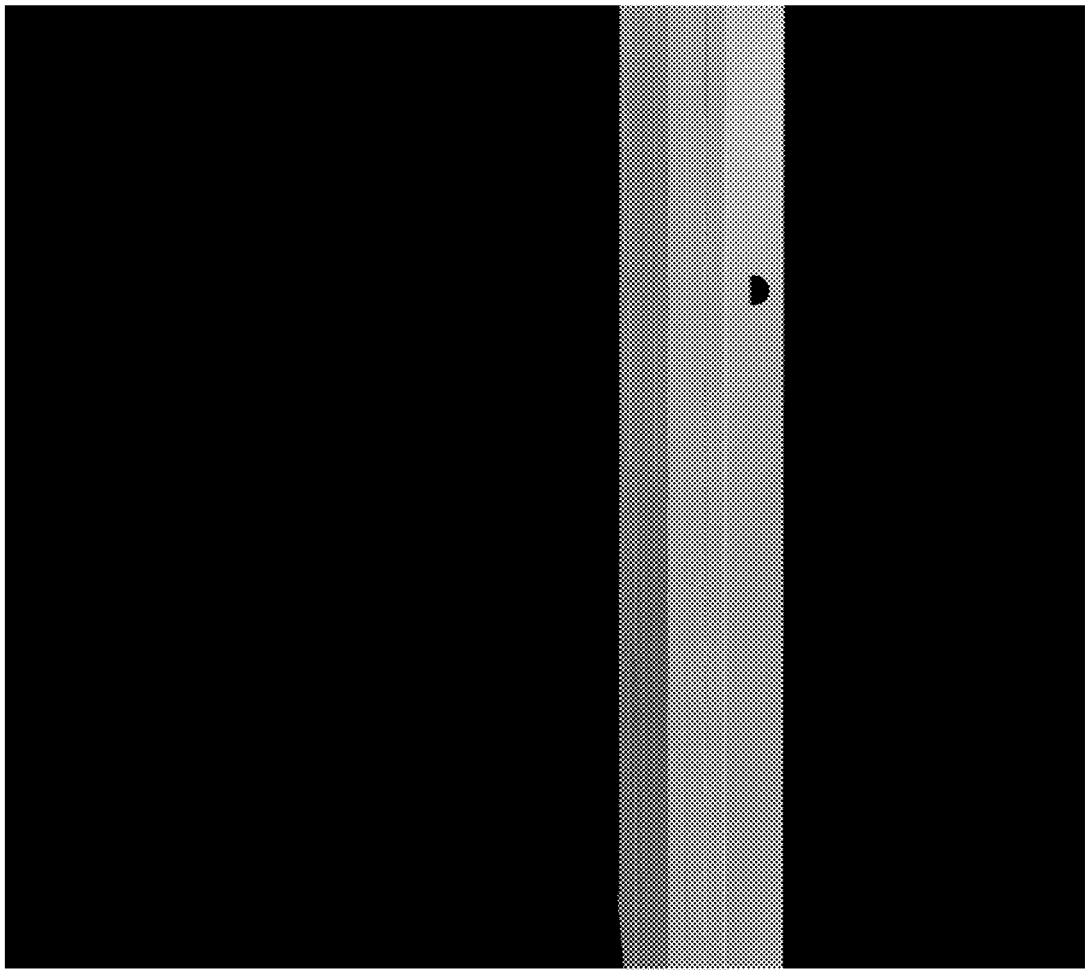
FIG. 2 is a side view of an exemplary embodiment of a system 2000.

FIG. 2 is a side view of an exemplary embodiment of a system 2000.

Figure 3:
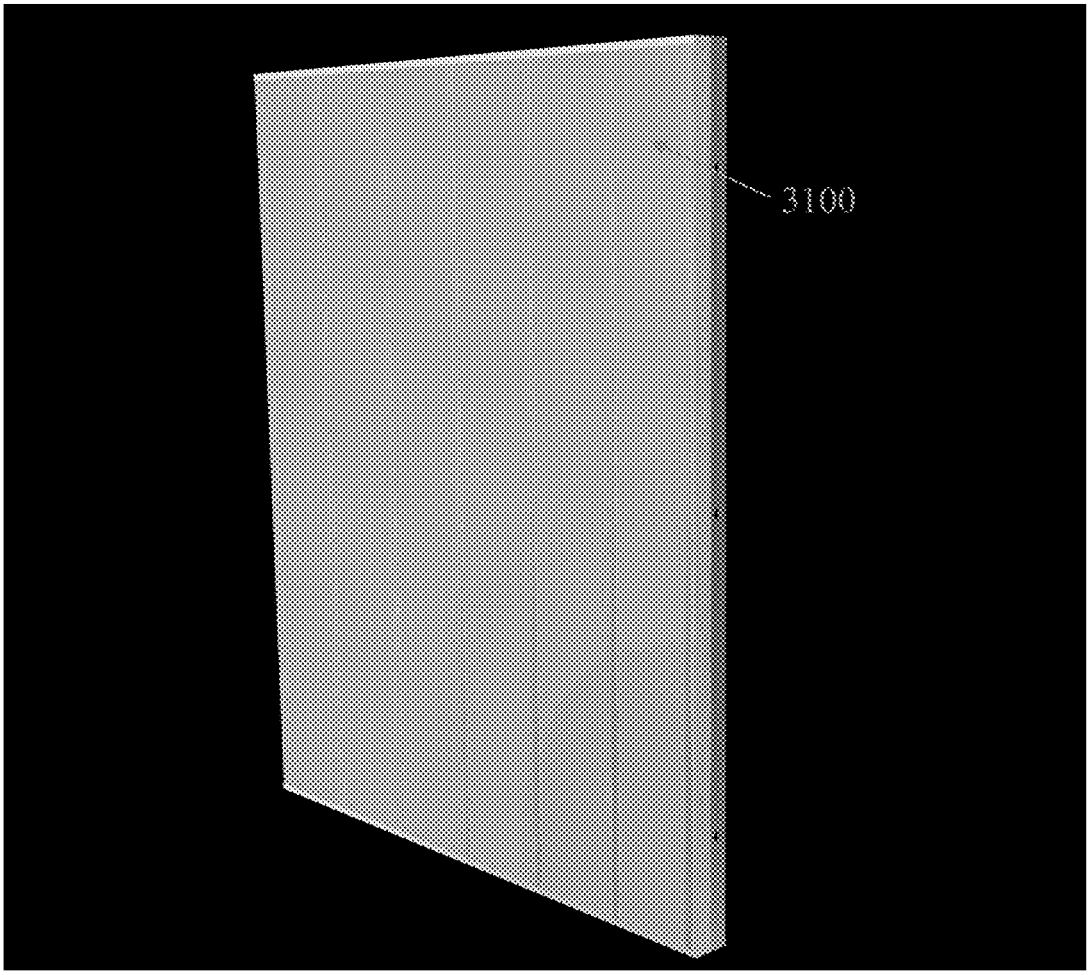
FIG. 3 is a perspective view of an exemplary embodiment of a wall frame 3000.

FIG. 3 is a perspective view of an exemplary embodiment of a wall frame 3000, which comprises insulation 3100. Insulation 3100 can be sprayed in the cells (see cells 1700 of FIG. 1) and substantially fills the cells. Insulation 3100 can substantially fill the cells (see cells 1700 of FIG. 1). Insulation 3100 can serves in place of sheathing and wall frame 3000 can lack sheathing. Insulation 3100 can be waterproof insulation.

Figure 4:
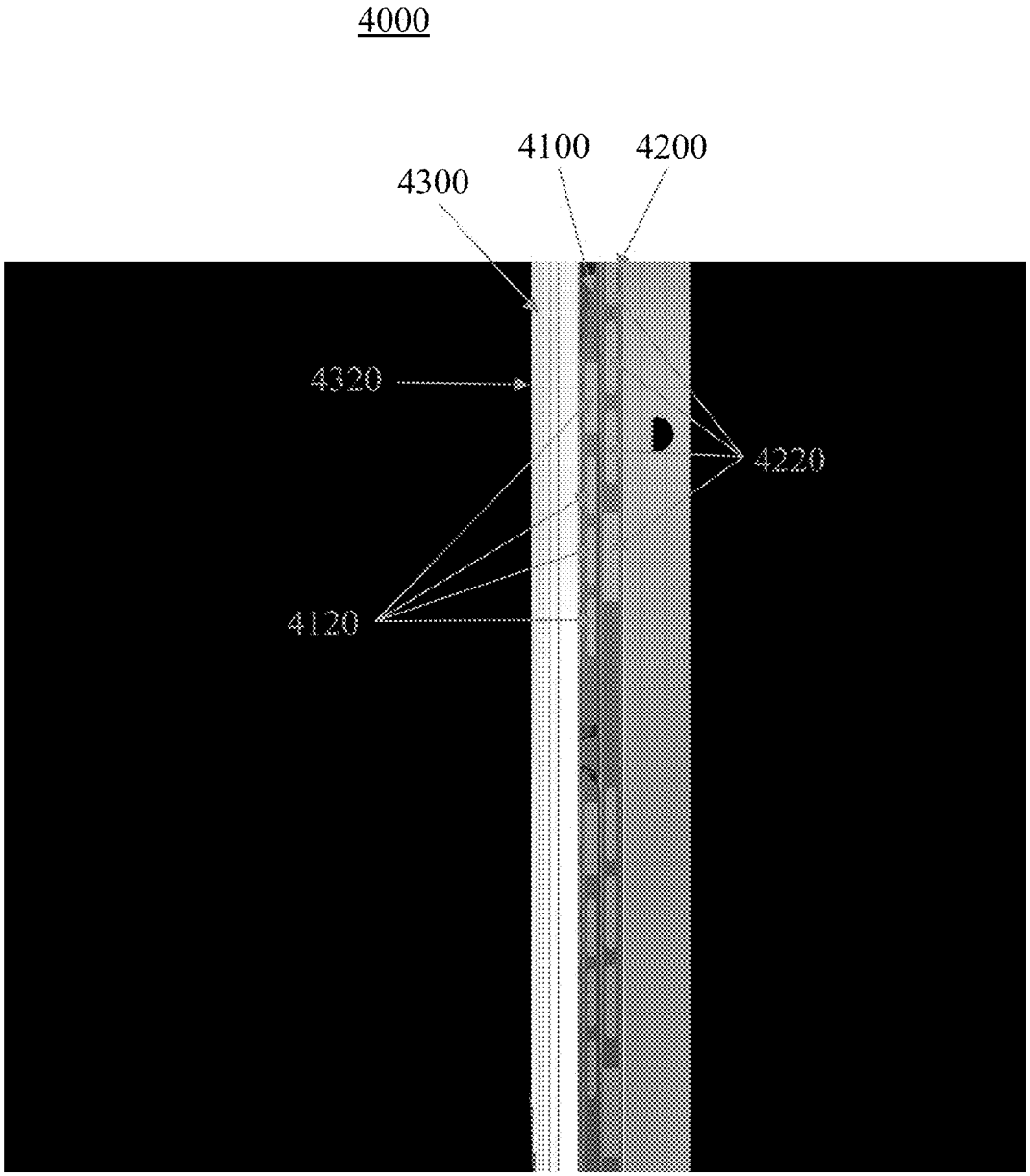
FIG. 4 is a side view of an exemplary embodiment of a system 4000.

FIG. 4 is a side view of an exemplary embodiment of a system 4000.

Referencing FIG. 1, each of top plate 1100, bottom plate 1200, first end column 1300, second end column 1400, and plurality of studs 1500 can have a layered structure. The layered structure can comprise:

a first slotted spacer 4100, first slotted spacer 4100 defining a first set of slots 4120;

a second slotted spacer 4200, second slotted spacer 4200 defining a second set of slots 4220, first set of slots 4120 not aligned with second set of slots 4220; and a cap 4300, cap 4300 comprising a substantially planar face 4320.

Figure 5:
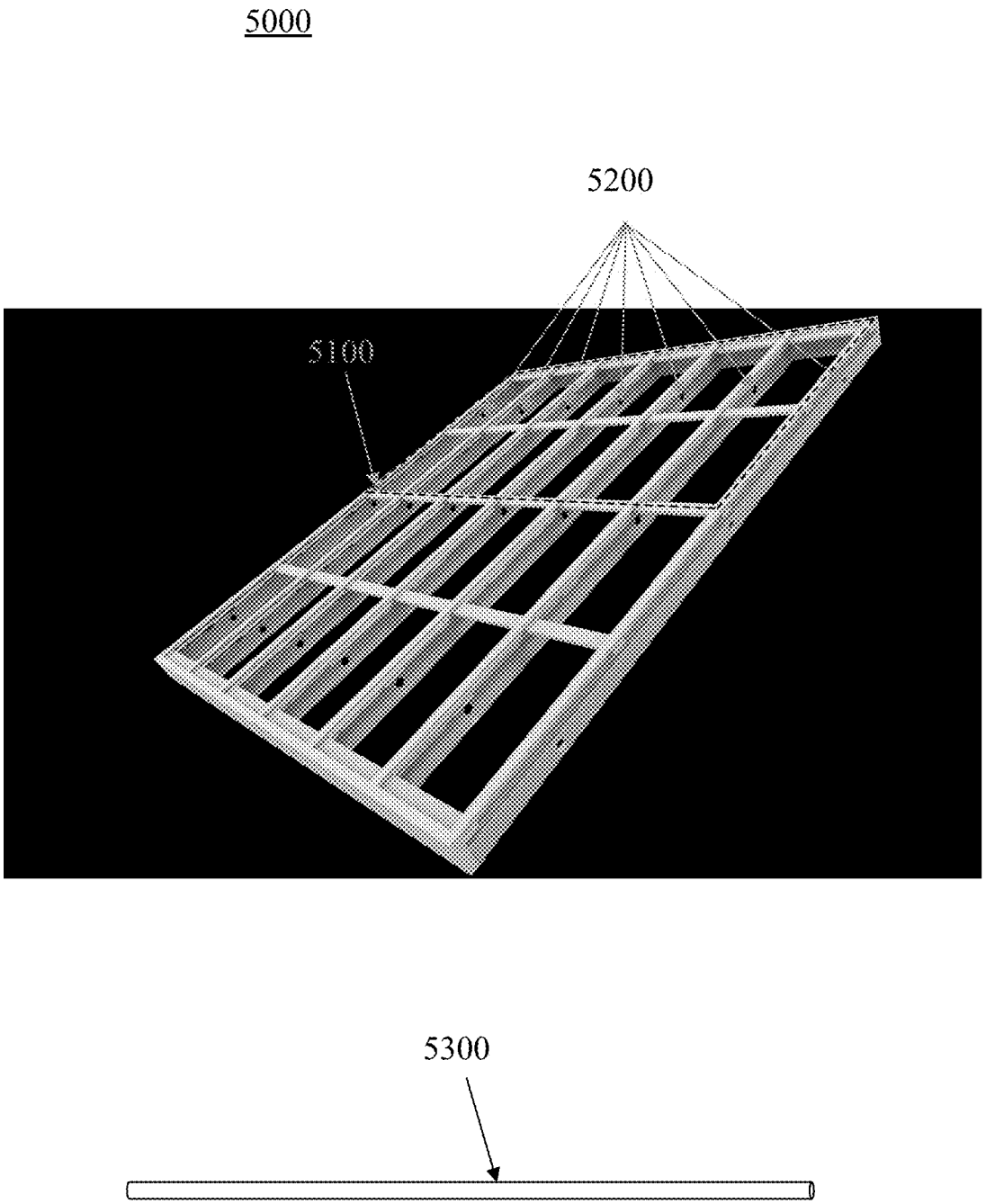
FIG. 5 is a perspective view of an exemplary embodiment of a system 5000.

FIG. 5 is a perspective view of an exemplary embodiment of a system 5000.

Figure 6:
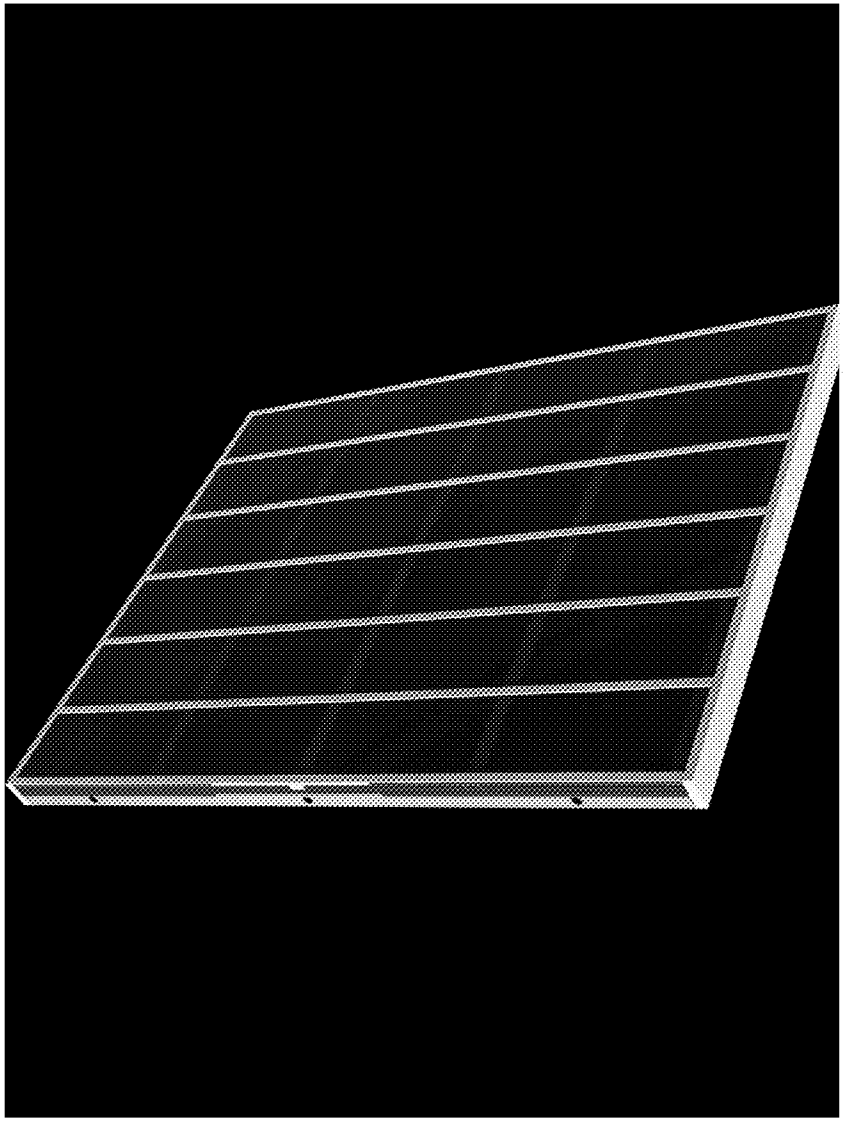
FIG. 6 is a perspective view of an exemplary embodiment of a system 6000.

FIG. 6 is a perspective view of an exemplary embodiment of a system 6000.

Figure 7:
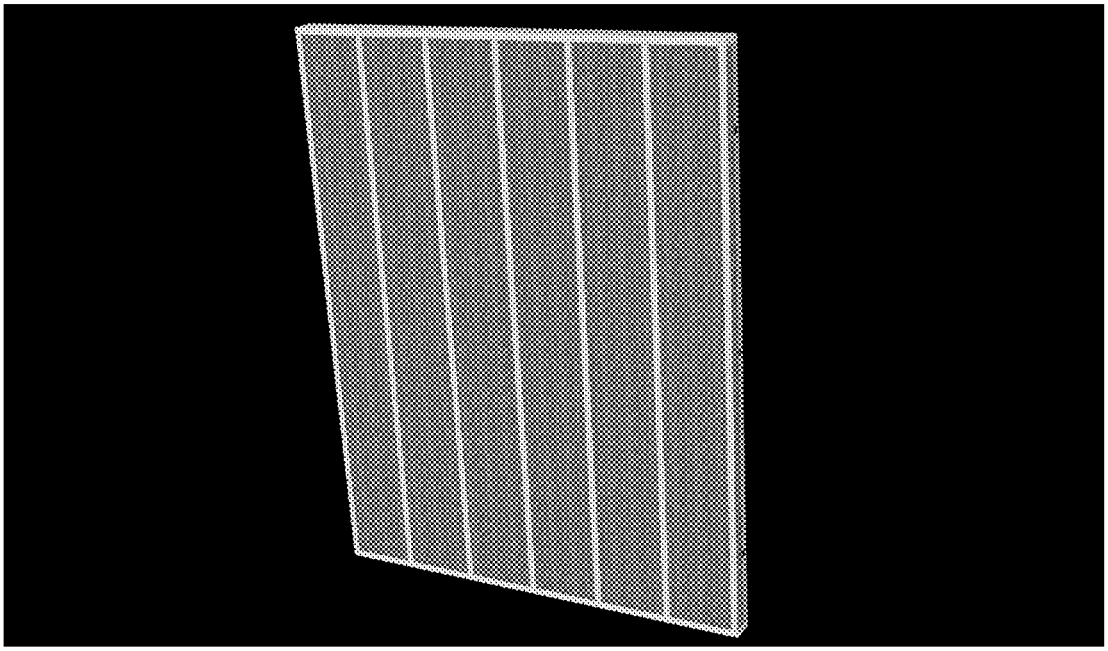
FIG. 7 is a perspective view of an exemplary embodiment of a system 7000.

FIG. 7 is a perspective view of an exemplary embodiment of a system 7000.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

activity—an action, act, step, and/or process or portion thereof adapter—a device used to effect operative compatibility between different parts of one or more pieces of an apparatus or system.

align—to restrain in a desired position and/or orientation.

and/or—either in conjunction with or in alternative to.

aperture—an opening in something.

apparatus—an appliance or device for a particular purpose associate—to join, connect together, and/or relate.

bottom—an lowermost portion of something when oriented in an installed position.

building—a walled structure.

can—is capable of, in at least some embodiments.

cap—a cover.

cause—to produce an effect.

cell—a bounded space.

column—a rigid, relatively slender, upright support.

component—a part of a system.

comprising—including but not limited to.
configure—to make suitable or fit for a specific use or situation.
connect—to join or fasten together.
constructed to—made to and/or designed to.
convert—to transform, adapt, and/or change.
couple—to physically join in some fashion.
coupleable—capable of being joined, connected, and/or linked together.
create—to bring into being.
define—to establish the outline, form, or structure of
determine—to obtain, calculate, decide, deduce, and/or ascertain.
device—a machine, manufacture, and/or collection thereof.
edge—an outside limit of an object, area, or surface.
end—a most extreme part of an object.
fill—to introduce something into a space to occupy the space.
frame—a supporting structure.
initialize—to prepare something for use and/or some future event.
install—to connect or set in position and prepare for use.
insulation—a material that is used to stop heat from going into or out of something.
layer—having a plurality of stratum.
a thickness of some homogeneous substance, such as a stratum or a coating on a surface
may—is allowed and/or permitted to, in at least some embodiments.
metal—a material that is typically hard, opaque, shiny, and has good electrical and thermal conductivity. Metals are generally malleable—that is, they can be hammered or pressed permanently out of shape without breaking or cracking—as well as fusible (able to be fused or melted) and ductile (able to be drawn out into a thin wire). About 91 of the 118 elements in the periodic table are metals.
method—a process, procedure, and/or collection of related activities for accomplishing something.
pair—two similar things used together.
plane—a substantially flat, two-dimensional surface.
planar—having a substantially flat surface.
plate—a substantially planar sheet of material having a thickness.
plurality—the state of being plural and/or more than one.
predetermined—established in advance.
provide—to furnish, supply, give, and/or make available.
purlin—a member in a frame.
recessed—located behind in space.
receive—to get, take, acquire, and/or obtain.
relative to—in comparison with.
rod—a thin straight bar.
set—a related plurality.
sheathing—a casing or covering.
slot—a narrow opening or groove.
spacer—a piece of material used to create or maintain a separation between two things.
spray—to cause a substance to be dispersed in a space by entraining the substance in an air stream and directing the air stream.
store—to place, hold, and/or retain.
stud—a slender, upright member, which forms a part of a wall frame.
structure—an arrangement of parts.
substantially—to a great extent or degree.
support—to bear the weight of, especially from below.
system—a collection of mechanisms, devices, machines, articles of manufacture, processes, data, and/or instructions, the collection designed to perform one or more specific functions.
top—an uppermost portion of something when oriented in an installed position.
transmit—to send, provide, furnish, and/or supply.
via—by way of and/or utilizing.
wall—an upright architectural partition with a height and length greater than its thickness and serving to enclose, divide, define, or protect an area or to support another structure.
waterproof—a weather resistant material that sheds water, such as pre-cast concrete, stone (e.g., marble, granite, etc.), roofing material, etc.
wood—the fibrous material which makes up the greater part of the stems and branches of trees and shrubby plants. Often used as a building material.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;
no characteristic, function, activity, or element is "essential";
any elements can be integrated, segregated, and/or duplicated;
any activity can be repeated, any activity can be performed by multiple entities, and/or any activity can be performed in multiple jurisdictions; and
any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A wall frame comprising:

a top plate;

a bottom plate;

a first end column;

a second end column;

a plurality of studs; and a plurality of purlins, wherein each of the plurality of purlins is an edge of a pair of cells, the pair of cells having edges comprising three edges that comprise one or more of a part of the top plate, a part of the bottom plate, a part of the first end column, a part of the second end column, a part of the plurality of studs, and another of the plurality of purlins;

wherein each of the top plate, the bottom plate, the first end column, the second end column, and the plurality of studs have a layered structure, the layered structure comprising:

a first slotted spacer, the first slotted spacer defining a first set of slots;

a second slotted spacer, the second slotted spacer defining a second set of slots, the first set of slots not aligned with the second set of slots; and a cap, the cap comprising a substantially planar face.

2. The wall frame of claim 1, wherein:

each of the first end column, the second end column, and the plurality of studs define at least one set of aligned apertures, the at least one set of aligned apertures constructed to receive a rod, the rod constructed to couple the wall frame to another building component.

3. The wall frame of claim 1, wherein:

the plurality of purlins is recessed relative to a plane defined by the cap of each of the top plate, the bottom plate, the first end column, the second end column, and the plurality of studs.

4. The wall frame of claim 1, wherein:

the wall frame comprises metal.

5. The wall frame of claim 1, wherein:

the wall frame comprises wood.

6. The wall frame of claim 1, wherein:

the wall frame comprises wood and metal.

7. The wall frame of claim 1, wherein:

the plurality of purlins comprise wood.

8. The wall frame of claim 1, wherein:

the plurality of purlins comprise metal.

9. The wall frame of claim 1, further comprising:

insulation, wherein the insulation is sprayed in the cells and substantially fills the cells.

10. The wall frame of claim 1, further comprising:

insulation, wherein:

the insulation is sprayed in the cells and substantially fills the cells; and the insulation serves in place of sheathing and the wall frame lacks sheathing.

11. The wall frame of claim 1, further comprising:

waterproof insulation, wherein the waterproof insulation is sprayed in the cells and substantially fills the cells.

* * * * *